US007194826B2

(12) United States Patent
Ungari

(10) Patent No.: US 7,194,826 B2
(45) Date of Patent: Mar. 27, 2007

(54) SOLE STRUCTURE WITH PIVOTING CLEAT ASSEMBLY

(75) Inventor: Joseph L. Ungari, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 265 days.

(21) Appl. No.: 10/774,295

(22) Filed: Feb. 6, 2004

(65) Prior Publication Data

US 2005/0172518 A1 Aug. 11, 2005

(51) Int. Cl.
*A43B 5/02* (2006.01)

(52) U.S. Cl. ..... 36/134; 36/128

(58) Field of Classification Search ..... 36/134, 36/116, 67 A, 114, 59 R, 61, 62, 67 R, 67 D, 36/126, 127, 128, 129, 130
See application file for complete search history.

(56) References Cited

U.S. PATENT DOCUMENTS

| | | | | | |
|---|---|---|---|---|---|
| 259,311 | A | * | 6/1882 | Horowitz | 36/61 |
| 1,361,078 | A | | 12/1920 | Lynn | |
| 2,484,389 | A | * | 10/1949 | Schatz | 36/114 |
| 3,337,972 | A | * | 8/1967 | Stollman et al. | 36/61 |
| 3,631,614 | A | * | 1/1972 | Rice | 36/61 |
| 3,680,231 | A | * | 8/1972 | Dymond | 36/59 R |
| 4,226,032 | A | * | 10/1980 | Herro | 36/127 |
| 4,240,215 | A | * | 12/1980 | Broussard | 36/67 D |
| 4,271,608 | A | | 6/1981 | Tomuro | |
| 4,375,729 | A | | 3/1983 | Buchanen, III | |
| 4,523,396 | A | * | 6/1985 | Dassler | 36/134 |
| 4,561,197 | A | | 12/1985 | Misevich | |
| 4,715,133 | A | | 12/1987 | Hartjes et al. | |
| 4,821,434 | A | | 4/1989 | Chein | |
| 4,873,774 | A | | 10/1989 | Lafever | |
| 5,289,647 | A | | 3/1994 | Mercer | |
| 5,299,369 | A | | 4/1994 | Goldman | |
| 5,377,431 | A | * | 1/1995 | Walker et al. | 36/134 |
| 5,505,012 | A | * | 4/1996 | Walker et al. | 36/134 |
| 5,526,589 | A | | 6/1996 | Jordan | |
| 5,617,653 | A | * | 4/1997 | Walker et al. | 36/134 |
| 5,709,042 | A | * | 1/1998 | Houdroge | 36/67 D |
| 5,740,619 | A | | 4/1998 | Broder | |
| 5,743,029 | A | * | 4/1998 | Walker et al. | 36/134 |
| 6,125,556 | A | | 10/2000 | Peckler et al. | |
| 6,266,897 | B1 | | 7/2001 | Seydel et al. | |
| 6,481,122 | B2 | * | 11/2002 | Brahler | 36/134 |
| 6,516,540 | B2 | | 2/2003 | Seydel et al. | |
| 2002/0026731 | A1 | * | 3/2002 | Brahler | 36/134 |

* cited by examiner

*Primary Examiner*—Ted Kavanaugh
(74) *Attorney, Agent, or Firm*—Banner & Witcoff, Ltd.

(57) ABSTRACT

A sole structure for an article of footwear includes a sole, and at least one cleat assembly pivotally connected to the sole such that a medial portion and a lateral portion of the cleat assembly can move upwardly and downwardly with respect to the sole. An upper may be secured to the sole structure to form an article of footwear.

48 Claims, 3 Drawing Sheets

SOLE STRUCTURE WITH PIVOTING CLEAT ASSEMBLY

FIELD OF THE INVENTION

This invention relates generally to a sole structure for an article of footwear, and, in particular, to a sole structure for an article of footwear having a pivoting cleat assembly.

BACKGROUND OF THE INVENTION

Athletes in many sports, including, for example, football, soccer, and lacrosse, use cleated footwear. Conventional cleated athletic footwear includes two primary elements, an upper and a sole. The upper is often formed of leather, synthetic materials, or a combination thereof, and comfortably secures the footwear to the foot, while providing ventilation and protection from the elements. The sole forms the ground-contacting element of footwear and is usually fashioned from a durable, wear resistant material that includes a plurality of cleats. The cleats extend from a lower surface of the sole and serve to engage the ground, thereby increasing traction for the user. Often times, the cleats are formed of one-piece construction with the sole. Alternatively, the cleats are removably secured to the sole, such as by a threaded member extending from the cleat that is received by a threaded member in the sole. In either case, the cleat is fixed with respect to the rest of the shoe when in use.

When a user running with cleated footwear turns or cuts, their leg is angled medially (referred to as inversion) or laterally (referred to as eversion) with respect to the ground. When cutting or turning, the user's cleats on both the lateral and medial side of known cleated footwear may remain engaged with the ground. In such a case, the sole and upper remain aligned with the cleats, while the user's leg is angled with respect to the sole, upper and cleats. This divergence between the footwear and the user's leg can result in injury, such as ankle and knee injuries. In cases where the user turns or cuts and both cleats do not remain engaged with the ground, the cleats on the side to which the leg is angled are engaged with the ground to a greater extent than the cleats on the opposite side. This results in decreased traction for the user. It would be desirable to provide cleated footwear that reduces the chance of injury to a user, and provides more even traction for cleats on both the lateral and medial sides of the footwear when the user's leg is angled to either side.

It is an object of the present invention to provide a sole structure for an article of footwear with a pivoted cleat assembly that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide a sole structure for an article of footwear that allows the cleats on the article of footwear to remain engaged with the ground while the user's leg is at a neutral angle with respect to the sole of the article of footwear.

In accordance with a first aspect, a sole structure for an article of footwear includes a sole, and at least one cleat assembly pivotally connected to the sole such that a medial portion and a lateral portion of the cleat assembly can move upwardly and downwardly with respect to the sole.

In accordance with another aspect, a sole structure for an article of footwear includes a sole and at least one recess formed in the sole. At least one cleat assembly is mounted to the sole for pivotal movement with respect to the sole. A portion of each cleat assembly is received in a corresponding recess when the cleat assembly pivots. Each cleat assembly includes a base member pivotally secured to the sole, a first cleat secured to a lateral area of the base member, and a second cleat secured to a medial area of the base member.

In accordance with a further aspect, an article of footwear includes an upper, and a sole secured to the upper. At least one cleat assembly is pivotally connected to the sole such that a medial end and a lateral end of the cleat assembly move upwardly and downwardly with respect to the sole.

In accordance with yet another aspect, an article of footwear includes an upper and a sole secured to the upper. At least one recess is formed in the sole. At least one cleat assembly is mounted to the sole for pivotal movement with respect to the sole. A portion of each cleat assembly is received in a corresponding recess when the cleat assembly pivots. Each cleat assembly includes a base member pivotally secured to the sole, a first cleat secured to a lateral area of the base member, and a second cleat secured to a medial area of the base member.

Substantial advantage is achieved by providing a sole structure for an article of footwear with a pivoting cleat assembly. In particular, providing a pivoting cleat assembly can help maintain the cleats in contact with the ground when the user's leg is angled toward the medial or lateral side, while maintaining the user's leg at a neutral angle with respect to the sole of the article of footwear. This is highly advantageous since such a pivoting cleat assembly can reduce the chance of injury to a user's leg. Further, such a pivoting cleat assembly can increase traction for the user.

These and additional features and advantages of the invention disclosed herein will be further understood from the following detailed disclosure of certain preferred embodiments.

Figure 1:
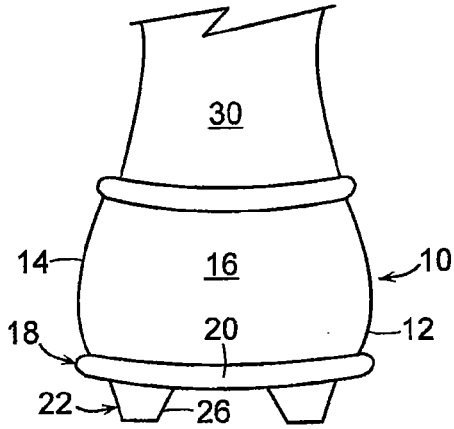
FIG. 1 is a rear elevation view of an article of footwear having a sole structure in accordance with a preferred embodiment of the present invention.

The figures referred to above are not drawn necessarily to scale and should be understood to present a representation of the invention, illustrative of the principles involved. Some features of the sole structure having a pivoting cleat assembly depicted in the drawings have been enlarged or distorted relative to others to facilitate explanation and understanding. The same reference numbers are used in the drawings for similar or identical components and features shown in various alternative embodiments. A sole structure having a pivoting cleat assembly as disclosed herein, would have configurations and components determined, in part, by the intended application and environment in which it is used.

DETAILED DESCRIPTION OF CERTAIN PREFERRED EMBODIMENTS

Figure 2:
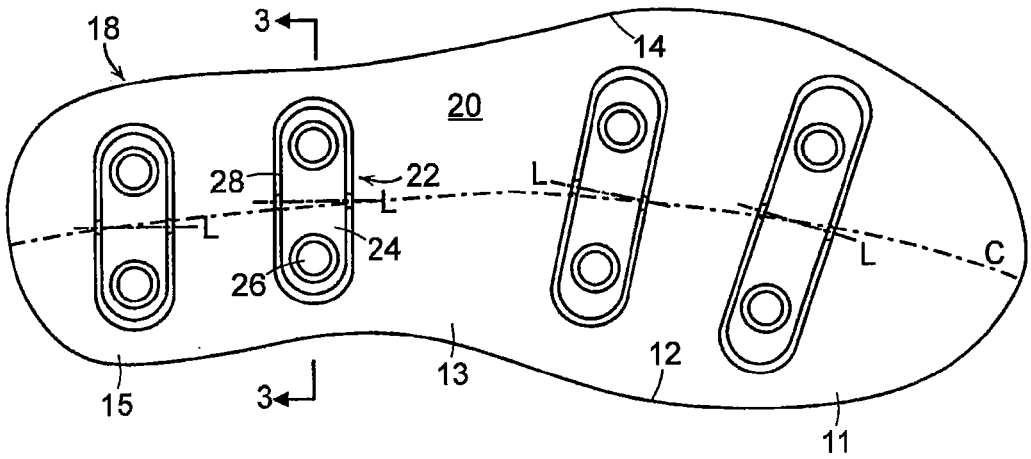
FIG. 2 is a bottom plan view of the sole of FIG. 1.

The present invention may be embodied in various forms. A preferred embodiment of an article of footwear 10 having a sole structure with a pivoting cleat assembly is shown in FIGS. 1–2. Footwear 10 has a medial, or inner, side 12 and a lateral, or outer, side 14. For purposes of general reference, footwear 10 may be divided into three general portions: a forefoot portion 11, a midfoot portion 13, and a heel portion 15, as depicted in FIG. 2. Portions 11, 13 and 15 are not intended to demarcate precise areas of footwear 10. Rather, portions 11, 13, and 15 are intended to represent general areas of footwear 10 that provide a frame of reference during the following discussion.

Footwear 10 includes an upper 16 and a sole structure 18 secured to upper 16. Sole structure 18, seen more clearly in FIG. 2, includes a sole 20 and a plurality of cleat assemblies 22 pivotally secured to sole 20. In the embodiment illustrated in FIG. 2, there are two cleat assemblies 22 secured to heel portion 15, with a first cleat assembly 22 positioned in a rear area of heel portion 15 and a second cleat assembly 22 positioned in a forward area of heel portion 15. Similarly, two cleat assemblies 22 are secured to forefoot portion 11 of footwear 10, with a first cleat assembly 22 positioned in a rear area of forefoot portion 11 and a second cleat assembly 22 positioned in a forward area of forefoot portion 11.

It is to be appreciated that although the illustrated embodiment shows four cleat assemblies pivotally secured to sole 20, any number of cleat assemblies 22 may be pivotally secured to, and secured at any position along, sole 20. In addition, although sole structure 18 as depicted here shows only pivotable cleat assemblies 22 secured to sole 20, it is to be appreciated that one or more pivoting cleat assemblies 22 may be mixed with one or more non-pivoting, or fixed, cleat assemblies (not shown) on sole 20.

Cleat assembly 22 is formed of a base member 24 and a plurality of cleats 26 secured to base member 24. In the illustrated embodiment, each cleat assembly 22 has two cleats 26, with one positioned on lateral side 14 and the other positioned on medial side 12 of base member 24. It is to be appreciated that any number of cleats may be secured to base member 24. As illustrated herein, cleats 26 are of unitary, that is, one-piece, construction with sole 20. It is to be appreciated that in other preferred embodiments, cleats 26 may be releasably secured to sole 20. Cleats 26 could include a male threaded extension that is received by a female threaded aperture in sole 20 (not shown). Other means for releasably securing cleats 26 to sole 20 will become readily apparent to those skilled in the art, given the benefit of this disclosure. Releasably securing cleats 26 to sole 10 would enable cleats 26 to be replaced when worn. Base member 24 and cleats 26 may be formed of nylon, rubber, or any other suitable material.

Each cleat assembly 22 is pivotally secured to sole 20 so as to pivot, or rock, with respect to sole 20 toward medial side 12 and lateral side 14 such that medial and lateral ends of each cleat assembly 22 will move upwardly and downwardly with respect to sole 20. Each cleat assembly 22 pivots about an axis L. Each axis L extends generally from heel portion 15 toward toe portion 11 of footwear 10. The axes L generally lie along a line C extending generally longitudinally along a center of sole 20.

Figure 3:
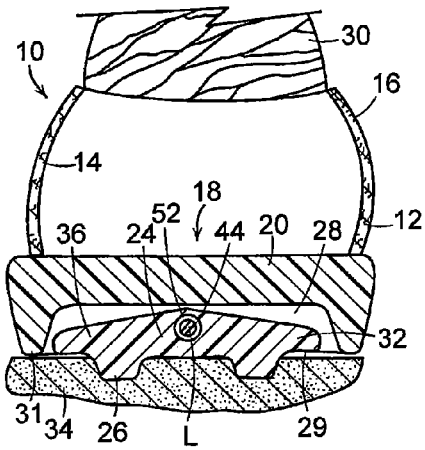
FIG. 3 is a section view, taken along line 3—3 of FIG. 2, showing a cleat assembly in a non-pivoted position with respect to the sole of the article of footwear.
Figure 4:
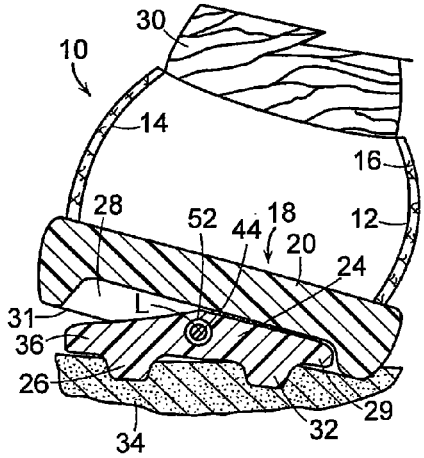
FIG. 4 is a section view showing the cleat assembly of the sole of FIG. 1 in a pivoted position with respect to the sole of the article of footwear.

A plurality of recesses 28 is formed in lower surface 29 of sole 20. As seen in FIGS. 3–4, each recess 28 is configured to receive at least a portion of a cleat assembly 22. In certain preferred embodiments, cleat assembly 22 is positioned in recess 28 such that a lower surface 29 of cleat assembly 22 is substantially coplanar with a lower surface 31 of sole 20.

As seen in FIG. 4, when a user's leg 30 is angled toward the medial side 12 of footwear 10, a medial portion 32 of base member 24 pivots upwardly into recess 28, while sole 20 is angled toward medial side 12. It is to be appreciated that this pivoting movement could alternatively be described as the medial side 12 of sole 20 pivoting downwardly toward base member 24. This pivoting, or rocking, movement of cleat assembly 22 with respect to sole 20 allows the user's leg 30 to remain at a neutral angle with respect to sole 20, thereby minimizing injuries to the user's leg. Further, even though the user's leg 30 and sole 20 are angled inwardly toward medial side 16, both cleats 22 of cleat assembly 22 remain fully engaged and in contact with ground 34, enhancing traction for the user. Naturally, if the user's leg 30 were to be angled toward lateral side 14, a lateral portion 36 of base member 24 would pivot upwardly into recess 28 in the same manner. This movement could alternatively be described as lateral side 14 of sole 20 pivoting downwardly toward base member 24.

Figure 5:
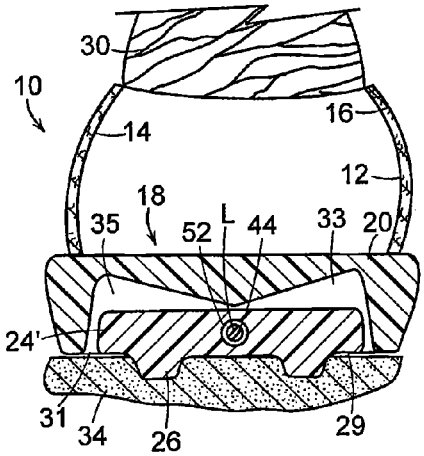
FIG. 5 is a section view showing an alternative embodiment of a sole structure for an article of footwear in accordance with the present invention.

In the illustrated embodiment, recess 28 has a substantially rectangular configuration, while medial portion 32 and lateral portion 36 of base member 24 each have a substantially triangular cross-section. In another embodiment, as illustrated in FIG. 5, a base member 24' has a substantially rectangular cross-section. A first recess 33 is positioned in medial side 12 of sole 20, and a second recess 35 is positioned in lateral side 14 of sole 20, each of which has an upper surface that is angled upwardly and outwardly from the center of sole 20. It can be appreciated that the shapes illustrated herein for both the recess and the cleat assembly of footwear 10 are merely exemplary, and that they may have one of any number of shapes.

In the embodiments illustrated herein, the depth of recess 28 restricts the amount that cleat assembly 22 can pivot with respect to sole 20. The greater the amount that cleat assembly 22 pivots, the greater the degree to which a user's leg 30 can be angled with respect to the ground and still realize the benefits of the present invention. The degree to which cleat assembly 22 pivots can be customized based on any number of factors, including, for example, the particular sport being engaged in by the user.

Figure 6:
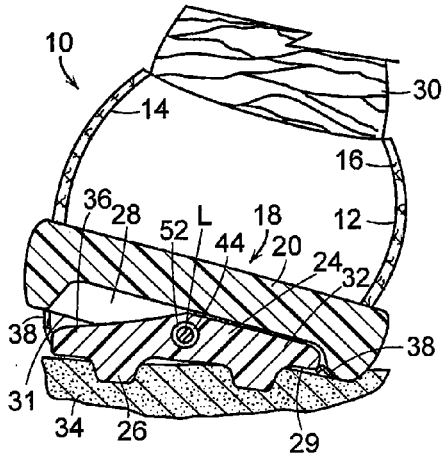
FIG. 6 is a section view showing another alternative embodiment of a sole structure for an article of footwear in accordance with the present invention.

In another preferred embodiment, as illustrated in FIG. 6, a flexible skirt 38 is secured at one edge thereof to the peripheral edge of cleat assembly 22 and at its other edge to the peripheral edge of recess 28. By extending across the gap between cleat assembly 22 and the edge of recess 28, skirt 38 acts to cover the exposed portion of recess 28, and keeps rocks, dirt and other debris from entering recess 28. Skirt 38 may be formed of any suitable flexible material, such as nylon or cloth materials. Skirt 38 may be secured to cleat assembly 22 and recess 28 by adhesive, stitching, or with any other suitable fastener.

Figure 7:
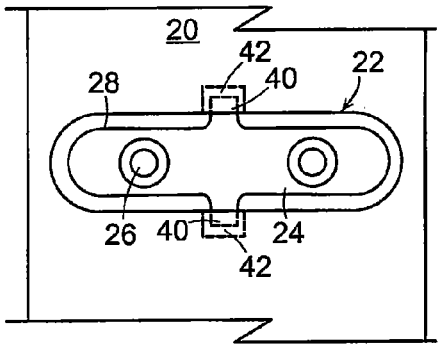
FIG. 7 is a bottom plan view of a preferred embodiment of a cleat assembly of the sole structure of FIG. 1.

One preferred embodiment of the pivotal attachment of cleat assembly 22 to sole 20 is illustrated in FIG. 7. In this embodiment, projections 40 extend from forward and rear surfaces of base member 24. Projections 40 are received in recesses 42 formed in forward and rear walls of recess 28. Projections 40 are free to pivot within recesses 42, allowing medial and lateral portions 32, 36 of cleat assembly 22 to pivot as described above. Projections 40 may be of unitary construction with base member 24. Alternatively, projections 40 could be separate elements secured to base member 24 by adhesive or any other fastener.

Figure 8:
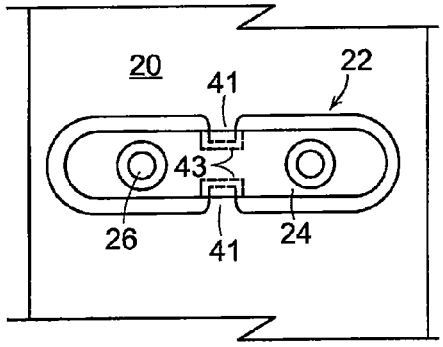
FIG. 8 is a bottom plan view of an alternative embodiment of a cleat assembly of the sole structure of FIG. 1.

Another preferred embodiment of the pivotal attachment of cleat assembly 22 to sole 20 is illustrated in FIG. 8. In this embodiment, projections 41 extend from forward and rear walls of recess 28. Projections 41 are received in recesses 43 formed in forward and rear surfaces of base member 24. Cleat assembly 22 pivots about projections 41, allowing medial and lateral portions 32, 36 of cleat assembly 22 to move up and down with respect to sole 20 as described above. Projections 41 may be of unitary construction with sole 20. Alternatively, projections 41 could be separate elements secured to sole 20 by adhesive or any other fastener.

Figure 9:
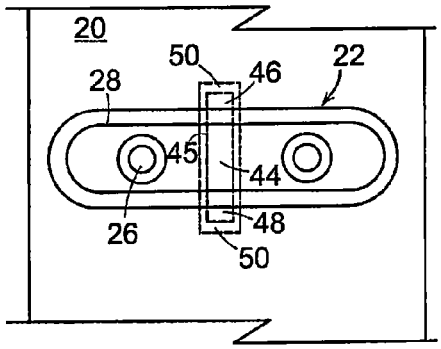
FIG. 9 is a bottom plan view of another alternative embodiment of a cleat assembly of the sole structure of FIG. 1.

Yet another preferred embodiment of the pivotal attachment of cleat assembly 22 to sole 20 is illustrated in FIG. 9. In this embodiment, a pin 44 extends through an aperture 45 formed in base member 24, with first and second ends 46, 48 of pin 44 projecting from forward and rear surfaces of base member 24, respectively. First and second ends 46, 48 are received in corresponding recesses 50 formed in forward and rear walls, respectively, of recess 28. Pin 44 may be secured to base member 24, in which case first and second ends 46, 48 of pin 44 pivot within recesses 50, allowing cleat assembly 22 to pivot medially and laterally as described above. Alternatively, pin 44 may not be secured to base member 24 such that base member 24 is free to pivot about pin 44. Other suitable structures for pivotally securing cleat assembly 22 to sole 20 will become readily apparent to those skilled in the art, given the benefit of this disclosure.

In light of the foregoing disclosure of the invention and description of the preferred embodiments, those skilled in this area of technology will readily understand that various modifications and adaptations can be made without departing from the scope and spirit of the invention. All such modifications and adaptations are intended to be covered by the following claims.

What is claimed is:

1. A sole structure for an article of footwear comprising, in combination:

a sole; and at least one cleat assembly extending across a substantial portion of a lateral portion of the sole and a substantial portion of a medial portion of the sole, and pivotally connected to the sole such that a medial portion and a lateral portion of the cleat assembly can move upwardly and downwardly with respect to the sole only about a single axis.

2. The sole structure of claim 1, wherein the axis about which each cleat assembly pivots extends generally from a heel portion to a toe portion of the sole.

3. The sole structure of claim 1, wherein each cleat assembly comprises a base member and at least two cleats extending from a lower surface of the base member.

4. The sole structure of claim 3, wherein each cleat assembly comprises a first cleat in a lateral portion of the base member and a second cleat in a medial portion of the base member.

5. The sole structure of claim 1, wherein each cleat assembly includes a first projection extending from a front surface of the cleat assembly and a second projection extending from a rear surface of the cleat assembly, the first and second projections received in first and second recesses, respectively, formed in the sole.

6. The sole structure of claim 1, wherein each cleat assembly includes a pin having a first end extending outwardly from a front surface of the cleat assembly and a second end extending outwardly from a rear surface of the cleat assembly, the first and second ends of the pin being received in first and second recesses, respectively, formed in the sole.

7. The sole structure of claim 6, wherein the pin extends through an aperture formed in the cleat assembly.

8. The sole structure of claim 1, further comprising at least one recess formed in a lower surface of the sole, each recess configured to receive a portion of a cleat assembly as it pivots with respect to the sole.

9. The sole structure of claim 8, wherein each recess comprises a first portion configured to receive a medial portion of a cleat assembly and a second portion configured to receive a lateral portion of a cleat assembly as the cleat assembly pivots with respect to the sole.

10. The sole structure of claim 8, further comprising at least one skirt, each skirt secured about a first edge thereof to a cleat assembly and about a second edge thereof to a corresponding recess.

11. The sole structure of claim 10, wherein each skirt is formed of a flexible material.

12. The sole structure of claim 1, wherein a cleat assembly is secured to a rear area of a heel portion of the sole.

13. The sole structure of claim 1, wherein a cleat assembly is secured to a forward area of a heel portion of the sole.

14. The sole structure of claim 1, wherein a cleat assembly is secured to a rear area of a forefoot portion of the sole.

15. The sole structure of claim 1, wherein a cleat assembly is secured to a forward area of a forefoot portion of the sole.

16. The sole structure of claim 1, wherein a first cleat assembly is secured to a rear area of a heel portion of the sole, a second cleat assembly is secured to a front area of the heel portion of the sole, a third cleat assembly is secured to a rear area of a forefoot portion of the sole, and a fourth cleat assembly is secured to a front area of the forefoot portion of the sole.

17. A sole structure for an article of footwear comprising, in combination:

a sole;

at least one recess formed in the sole; and at least one cleat assembly mounted to the sole for pivotal movement with respect to the sole, a portion of each cleat assembly being received in a corresponding recess when the cleat assembly pivots, each cleat assembly comprising a base member pivotally secured to the sole and having lateral and medial portions that move upwardly and downwardly with respect to the sole only about a single axis;

a first cleat secured to a lateral area of the base member; and a second cleat secured to a medial area of the base member.

18. The sole structure of claim 17, further comprising at least one skirt, each skirt secured about a first edge thereof to a cleat assembly and about a second edge thereof to a corresponding recess.

19. The sole structure of claim 18, wherein each skirt is formed of a flexible material.

20. The sole structure of claim 17, wherein a cleat assembly is secured to a rear area of a heel portion of the sole.

21. The sole structure of claim 17, wherein a cleat assembly is secured to a forward area of a heel portion of the sole.

22. The sole structure of claim 17, wherein a cleat assembly is secured to a rear area of a forefoot portion of the sole.

23. The sole structure of claim 17, wherein a cleat assembly is secured to a forward area of a forefoot portion of the sole.

24. The sole structure of claim 17, wherein a first cleat assembly is secured to a rear area of a heel portion of the sole, a second cleat assembly is secured to a front area of the heel portion of the sole, a third cleat assembly is secured to a rear area of a forefoot portion of the sole, and a fourth cleat assembly is secured to a front area of the forefoot portion of the sole.

25. An article of footwear comprising, in combination:

an upper;

a sole secured to the upper;

at least one cleat assembly pivotally extending across a substantial portion of a lateral portion of the sole and a substantial portion of a medial portion of the sole, and connected to the sole such that a medial end and a lateral end of the cleat assembly move upwardly and downwardly with respect to the sole only about a single axis.

26. The sole structure of claim 25, wherein the axis about which each cleat assembly pivots extends generally from a heel portion to a toe portion of the sole.

27. The sole structure of claim 25, wherein each cleat assembly comprises a base member and at least two cleats extending from a lower surface of the base member.

28. The sole structure of claim 27, wherein each cleat assembly comprises a first cleat in a lateral portion of the base member and a second cleat in a medial portion of the base member.

29. The sole structure of claim 25, wherein each cleat assembly includes a first projection extending from a front surface of the cleat assembly and a second projection extending from a rear surface of the cleat assembly, the first and second projections received in first and second recesses, respectively, formed in the sole.

30. The sole structure of claim 25, wherein each cleat assembly includes a pin having a first end extending outwardly from a front surface of the cleat assembly and a second end extending outwardly from a rear surface of the cleat assembly, the first and second ends of the pin being received in first and second recesses, respectively, formed in the sole.

31. The sole structure of claim 30, wherein the pin extends through an aperture formed in the cleat assembly.

32. The sole structure of claim 25, further comprising at least one recess formed in a lower surface of the sole, each recess configured to receive a portion of a cleat assembly as it pivots with respect to the sole.

33. The sole structure of claim 32, wherein each recess comprises a first portion configured to receive a medial portion of a cleat assembly and a second portion configured to receive a lateral portion of a cleat assembly as the cleat assembly pivots with respect to the sole.

34. The sole structure of claim 32, further comprising at least one skirt, each skirt secured about a first edge thereof to a cleat assembly and about a second edge thereof to a corresponding recess.

35. The sole structure of claim 34, wherein each skirt is formed of a flexible material.

36. The sole structure of claim 25, wherein a cleat assembly is secured to a rear area of a heel portion of the sole.

37. The sole structure of claim 25, wherein a cleat assembly is secured to a forward area of a heel portion of the sole.

38. The sole structure of claim 25, wherein a cleat assembly is secured to a rear area of a forefoot portion of the sole.

39. The sole structure of claim 25, wherein a cleat assembly is secured to a forward area of a forefoot portion of the sole.

40. The sole structure of claim 25, wherein a first cleat assembly is secured to a rear area of a heel portion of the sole, a second cleat assembly is secured to a front area of the heel portion of the sole, a third cleat assembly is secured to a rear area of a forefoot portion of the sole, and a fourth cleat assembly is secured to a front area of the forefoot portion of the sole.

41. An article of footwear comprising, in combination:

an upper;

a sole secured to the upper;

at least one recess formed in the sole; and at least one cleat assembly mounted to the sole for pivotal movement with respect to the sole, a portion of each cleat assembly received in a corresponding recess when the cleat assembly pivots, each cleat assembly comprising a base member pivotally secured to the sole and having lateral and medial portions that move upwardly and downwardly with respect to the sole only about a single axis;

a first cleat secured to a lateral area of the base member; and a second cleat secured to a medial area of the base member.

42. The sole structure of claim 41, further comprising at least one skirt, each skirt secured about a first edge thereof to a cleat assembly and about a second edge thereof to a corresponding recess.

43. The sole structure of claim 42, wherein each skirt is formed of a flexible material.

44. The sole structure of claim 41, wherein a cleat assembly is secured to a rear area of a heel portion of the sole.

45. The sole structure of claim 41, wherein a cleat assembly is secured to a forward area of a heel portion of the sole.

46. The sole structure of claim 41, wherein a cleat assembly is secured to a rear area of a forefoot portion of the sole.

47. The sole structure of claim 41, wherein a cleat assembly is secured to a forward area of a forefoot portion of the sole.

48. The sole structure of claim 41, wherein a first cleat assembly is secured to a rear area of a heel portion of the sole, a second cleat assembly is secured to a front area of the heel portion of the sole, a third cleat assembly is secured to a rear area of a forefoot portion of the sole, and a fourth cleat assembly is secured to a front area of the forefoot portion of the sole.

* * * * *

UNITED STATES PATENT AND TRADEMARK OFFICE

CERTIFICATE OF CORRECTION

PATENT NO. : 7,194,826 B2
APPLICATION NO. : 10/774295
DATED : March 27, 2007
INVENTOR(S) : Joseph L. Ungari It is certified that error appears in the above-identified patent and that said Letters Patent is hereby corrected as shown below:

Column 7, lines 20-22 should read as follows:

at least one cleat assembly "pivotally" extending across a substantial portion of a lateral portion of the sole and a substantial portion of a medial portion of the sole, and
--pivotally--

Signed and Sealed this

First Day of May, 2007

JON W. DUDAS
*Director of the United States Patent and Trademark Office*